US005906205A

United States Patent [19]

Hiebert

[11] Patent Number: 5,906,205

[45] Date of Patent: May 25, 1999

[54] SURGICAL POSITIONING DEVICE

[76] Inventor: Eugene Lloyd Hiebert, 3871 Concomly Dr. SE., Salem, Oreg. 97306

[21] Appl. No.: 09/123,584

[22] Filed: Jul. 28, 1998

[51] Int. Cl.[6] ..... A61G 15/00

[52] U.S. Cl. ..... 128/845; 128/846; 5/713

[58] Field of Search ..... 128/845, 846, 128/DIG. 20, 869, 870; 5/454, 621, 628, 630, 633, 634, 694, 708, 713

[56] References Cited

U.S. PATENT DOCUMENTS 3,762,404 10/1973 Sakita ..... 128/DIG. 20
5,634,222 6/1997 Zwickey ..... 128/845
5,647,079 7/1997 Hakamium ..... 5/713
5,659,908 8/1997 Nishino ..... 5/676

*Primary Examiner*—Michael A. Brown
*Attorney, Agent, or Firm*—Klarquist Sparkman Campbell Leigh & Whinston, LLP

[57] ABSTRACT

A surgical positioning device for supporting the body of a patient in a selected lateral position comprises a bag made of flexible, air-impermeable material filled with a charge of elastically deformable expanded polystyrene beads, and includes a valve for evacuating air from the bag such that the bag forms a rigid structure to support the patient's body in the selected position. An inflatable pillow is attached to the upper edges of the bag at the center thereof such that when inflated, the pillow supports the patient's axilla and eliminates pressure, thereby to prevent injury to the patient's brachial plexus.

9 Claims, 3 Drawing Sheets

SURGICAL POSITIONING DEVICE

FIELD OF THE INVENTION

This invention relates to an improved positioning aid or device for supporting, restraining and immobilizing a portion of the body of a patient during medical treatment and, more particularly, for supporting, restraining and immobilizing the patient when in the lateral position during surgery.

BACKGROUND OF THE INVENTION

Vacuum actuated positioning aids or devices are utilized in the operating room for positioning patients in the supine, prone and lateral positions. They are most frequently used when the patient is in the lateral position, i.e., on his or her side, for a multitude of surgical procedures, such as brain, chest, kidney, shoulder and hip surgery, to name but a few. The devices typically comprise a flexible air impervious bag containing small, elastically deformable particles or beads which consolidate into a rigid mass when the bag is evacuated. See, for example, U.S. Pat. No. 3,762,404 to Sakita. Devices according to the Sakita patent are sold by Olympic Medical, 5900 First Avenue South, Seattle, Wash. 98108, under the trademark Vac-Pac®, and are available in a variety of sizes.

Devices of this type are typically filled with thousands of tiny, elastically deformable, generally spherical, plastic beads. When a device of this type is in the soft (unevacuated) condition, the beads are free to move around so that the device can be molded to the patient's body. When air is removed (using a vacuum source), atmospheric pressure forces the beads together into a solid mass, comfortably positioning, yet immobilizing the patient in the selected position. Allowing air back into the device returns it to its initial soft condition, ready for re-use.

Currently available positioning aids, however, suffer from a variety of deficiencies. Principal among them is their lack of adequate brachial plexus protection when an anaesthetized patient is immobilized in the lateral position. When an anaesthetized patient is placed in the lateral position and immobilized using one of these devices, the brachial plexus must be protected from stretching and compression. Otherwise serious injury is possible.

Also, currently available aids are not able to be attached to the operating table in a safe and efficient manner. Currently available aids are also not provided with disposable, waterproof slipcovers or shells to protect them from being soiled during surgery.

It is thus the principal object of the present invention to provide an improved vacuum actuated surgical positioning aid that will provide the patient with adequate brachial plexus protection when in the lateral position.

It is a further object of the invention to provide a positioning aid as aforesaid that can easily be secured to the operating table to maintain the immobilized anaesthetized patient in a safe condition.

It is a still further object of the present invention to provide a positioning aid as aforesaid with a disposable, waterproof protective slipcover or outer shell, which is easily attached and can protect the device from being soiled, thereby to allow the device to be reused many times.

It is a still further object of the present invention to provide a method of supporting the body of an anaesthetized patient in a selected lateral position, which will provide adequate protection to the patient's brachial plexus.

SUMMARY OF THE INVENTION

My surgical positioning device comprises a bag made of flexible, air impermeable material. The bag has top and bottom opposing walls, which are air impermeably joined at their upper, lower and lateral edges. They have a width at least equal to the sum of the widths of the lateral portion of the patient's torso plus about one-half the widths of the anterior and posterior portions of the patient's torso. The length of the walls is about the same as the length of an average height patient's torso.

The bag has a charge of elastically deformable beads disposed within it. A valve which communicates with the interior of the bag is provided for evacuating air therefrom, whereupon the beads in the bag interengage or consolidate to form a rigid structure conforming to and supporting the patient's body in a selected position.

An inflatable pillow is attached to the upper edges of the bag's walls substantially centrally thereof. Means are provided to inflate the pillow, such that the pillow when inflated can provide support for the patient's axilla (arm pit), preventing the rest of the bag from exerting undue pressure or tension on the axilla, thereby to prevent injury to the patient's brachial plexus.

At least one laterally extending strap is provided for attaching the device to the sides of a surgical operating table, thereby safely maintaining the patient and the bag on the table. The invention may be provided with a protective disposable, waterproof slipcover to prevent the bag from being soiled.

My method comprises providing a device as aforesaid; placing the device on an operating table with the inflatable pillow toward the head of the table; evenly distributing the beads within the device; placing the patient on the device in the selected lateral position, the patient being placed in the longitudinal center of the device with the lower axilla of the patient centered over the inflatable pillow; inflating the pillow to support the patient's axilla with radial artery pulse present in the lower arm; folding the lateral portions of the device up toward the anterior and posterior portions of the patient's torso; packing the lateral portions of the device snugly against the anterior and posterior portions of the patient's torso to accommodate the natural contours thereof; and evacuating air from the interior of the device while holding the patent in the selected position to cause the beads to interengage to form a rigid structure conforming to the contours of the patient's torso.

As respects smaller patients, my method comprises folding the inflatable pillow toward the center of the device, and then placing the patient on the device with the lower axilla centered over the pillow.

DESCRIPTION OF THE PREFERRED EMBODIMENTS

First Embodiment

Figure 1:
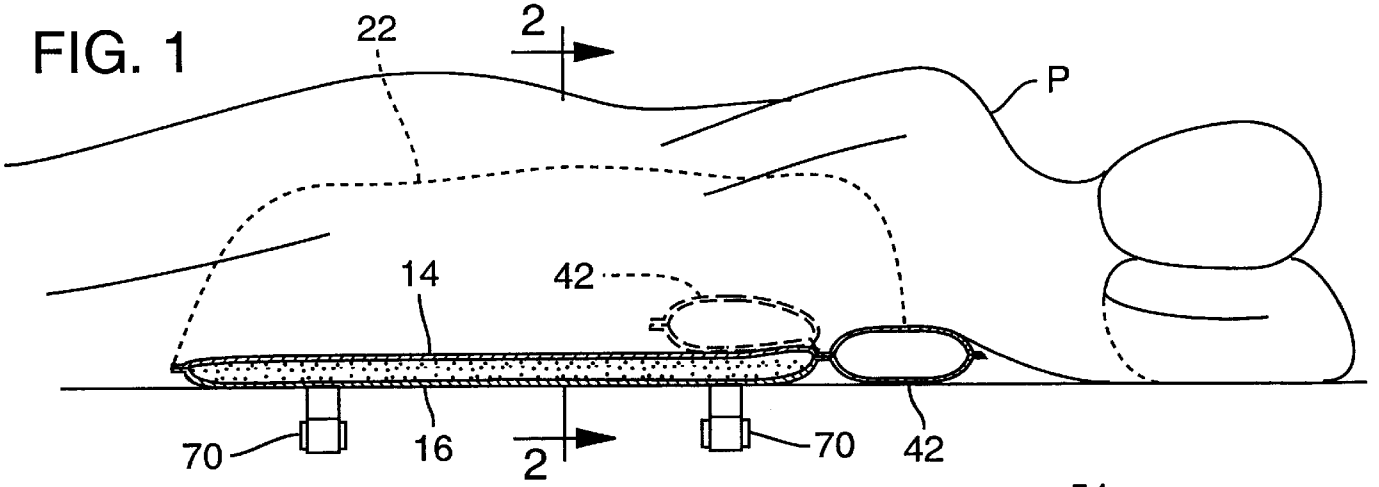
FIG. 1 is a side view, partially in section, of a patient in a selected lateral position on the surgical positioning device of the invention.
Figure 6:
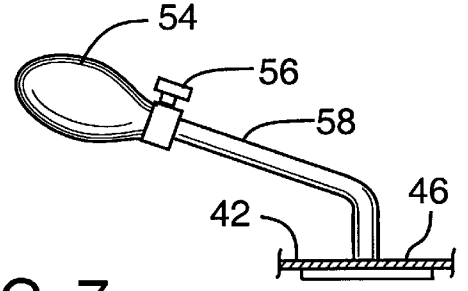
FIG. 6 is a side view of the apparatus used to inflate the axilla support pillow.

Referring to the drawings and particularly to FIGS. 1–7, my surgical positioning device 10 comprises a generally flat bag 12 fabricated of flexible, air impermeable material. A suitable material is "Rocheux Supreme" polyvinyl waterbed film, distributed by Rocheux International, Inc., 1315 Watson Center Road, Carson, Calif. 90745, although other materials having similar physical properties may be used. The Rocheux material has superior low temperature, tear, heat sealing and flexing qualities, also superior hydrostatic resistance which makes it particularly suitable for the present invention. It has good resilience, returning quickly to its prior conformation, thereby holding the patient more securely. It is mildew-, bacteria-, puncture- and fire-resistant. Its physical properties are specifically as follows:

| | | |
|---|---|---|
| Thickness (inches) | 0.024, +5%, −0 | ASTM D-751 |
| Embossing | Plain | |
| Weight (oz./yd.$^2$) | 17.5 (min.) | ASTM D-751 |
| Volatility (% loss) | 1.5 (max) | ASTM D-1203-86, Method B |
| Elongation (%) | 350–360 (min) | ASTM D-882 |
| Elongation change after 14 days × 150° F. (%) | Less than 10 | ASTM D-882 |
| Breaking strength factor (psi) | 44 | ASTM D-882 |
| Tensile change after 14 days × 150° F. (%) | Less than 10 | ASTM D-882 |
| Graves tear (lbs.) | 5.6 (min) | ASTM D-1004 |
| Low temperature (°F.) | −20 (min) | ASTM D-1790 |
| Dimensional stability (%) | −5 (max) | ASTM D-1204 |
| Specific gravity | 1.21–1.23 | ASTM D-792 |
| Mildew resistance | Passes ATCC No. 6275 | California Bureau of Home Furnishings, Bulletin 128 |
| Bacteria resistance | Passes ATCC No. 6538, 4352 | California Bureau of Home Furnishings, Bulletin 128 |
| Hydraulic resistance (psi) | 75 | ASTM D-75 1 |
| Puncture resistance (lbs.) | 34.3 | California Bureau of Home Furnishings, Bulletin 100 |

As shown in FIGS. 1–5, the bag 12 comprises top and bottom opposing walls 14, 16, which are radio frequency welded together at their upper, lower and lateral edges 18, 20, 22 for strength and airtightness. The bag's preferred overall dimensions are a width of 36 inches at the lower edge 20 and a length of 32 inches along both lateral edges 22. The upper edges 18 of the walls 14, 16 are indented at the lateral center of the bag such that the longitudinal length of the bag 12 is reduced four inches along a fourteen inch center portion 24 at the upper edge 18 thereof to create a pair of support regions 26, one on each side. The regions 26 provide upper shoulder and posterior thoracic support for the patient.

The 36 inch width of the bag 12 is about equal to the sum of the widths of the lateral portion of a typical patient's torso plus about one-half the widths of his torso's anterior and posterior portions. Thus, when the patient is placed in the lateral position on the bag 12 at the longitudinal center thereof, as shown in FIG. 1, the lateral edges 22 of the bag can be folded upwardly along the anterior and posterior portions of the patient's body and packed snugly thereagainst to accommodate the natural contours thereof. See FIG. 2. The 32-inch length is about the same as the length of an average or even an above average height patient.

Before the walls 14, 16 are welded together as aforesaid, the bag is filled with a charge of elastically deformable plastic beads 28. The beads 28 are preferably made of expanded plastic materials, such as polystyrene or polyvinyl chloride, because of their high mechanical strength, elastic deformability and low specific gravity. Beads 28 of expanded polystyrene are especially preferred. When the bag 12 is in the unevacuated condition, the beads 28 remain loose within the bag 12 such that the lateral edges 22 of the bag 12 can be easily moved or folded up toward the anterior and posterior portions of the patient's torso to cradle and support the patient in the selected position.

Figure 7:
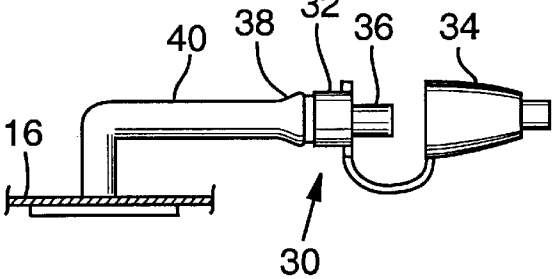
FIG. 7 is a side view of the valve used to evacuate air from the interior of the bag.
Figure 2:
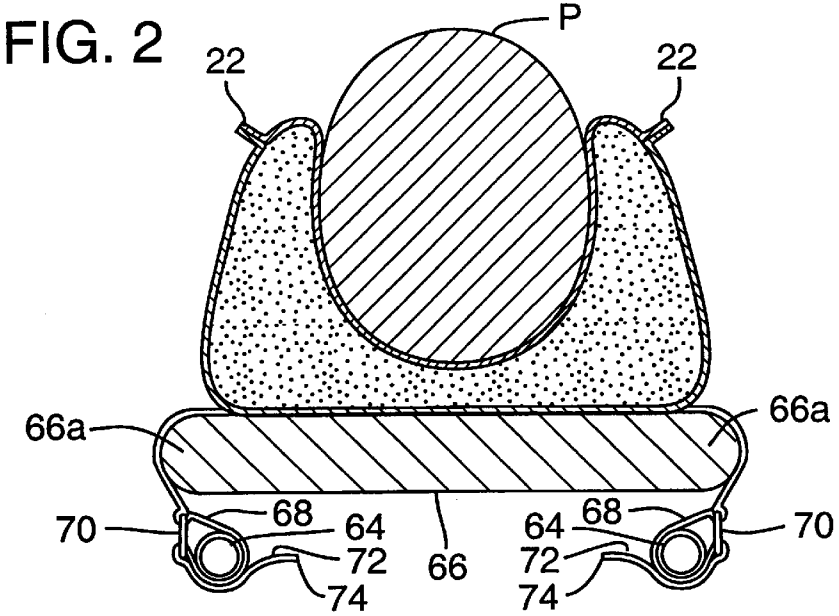
FIG. 2 is a sectional view on line 2—2 of FIG. 1.

The bottom wall 16 of the bag 12 provided with a valve 30 which communicates with the interior of the bag 12 for evacuating air therefrom. See FIGS. 3, 5 and 7. A preferred valve suitable for this use is supplied by Colder Products Company, 1001 Westgate Drive, St. Paul, Minn. 55114, as its part number LSO 176-226. Other valves having similar properties can be used. As shown in FIG. 7, the valve 30 comprises male and female portions 32, 34. The total length of the valve 30 is 3.04 inches. The male portion 32 comprises a valve stem 36 that protrudes from it when the valve 30 is closed. The proximal part 38 of the male portion 32 is inserted into a ⅜ inch inner diameter plastic tube 40 which is radio frequency welded to the bottom wall 16 for strength and airtightness. The female portion 34 is releasably placed over the male portion 32 to depress the valve stem 36 to open the valve 30 and allow ingress or egress of air. When a source of vacuum (not shown) is attached to the female portion 34, air is withdrawn from the interior of the bag 12. This causes the plastic beads 28 to be packed (or to congregate) into a tight configuration, conforming to the contours of the patient's torso, as shown in FIG. 2. When the female portion 34 is removed from the male portion 32, the valve in the male portion 32 closes and no air can enter or exit the bag 12, thereby maintaining the acquired conformity of the bag about the patient's torso.

Figure 4:
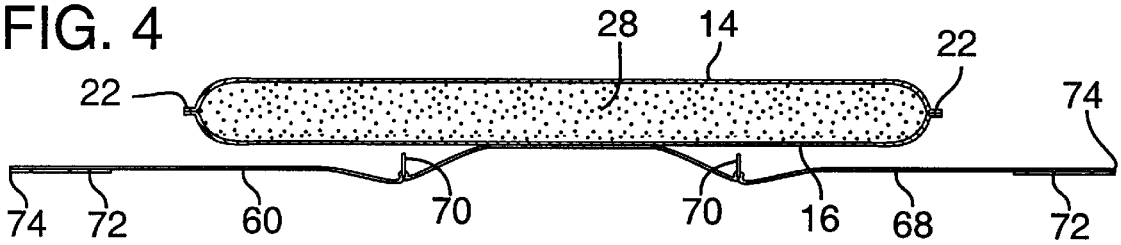
FIG. 4 is a sectional view on line 4—4 of FIG. 3.
Figure 5:
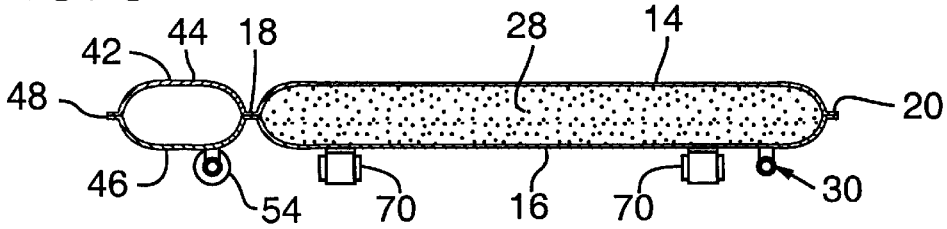
FIG. 5 is a sectional view on line 5—5 of FIG. 3.

When the patient is to be released, the female portion 34 of the valve 30 (without the vacuum hose attached) is placed over the male portion 32. This opens the valve 30, thereby allowing air to enter the bag 12, disrupting the configuration of the plastic beads 28 and allowing the bag 12 to become flat and flaccid; that is, as shown in FIGS. 4 and 5. The valve 30 can also be opened by pressing the thumb nail down on the valve stem 36 of the male portion 32. This also releases the vacuum.

It is to be noted that this first embodiment comprises a bag 12 which has no interior seams or baffles to divide the bag into longitudinally extending compartments. I have found that in some situations such seams or baffles cause hinging of the bag along the seam or baffle, thereby decreasing the bag's ability to hold the patient fly without any movement. When a vacuum is drawn on the interior of the bag 12 of this first embodiment, all the plastic beads 28 congregate to create an uninterrupted rigid mass of beads which creates a firm solid mass to stabilize the patient.

Figure 3:
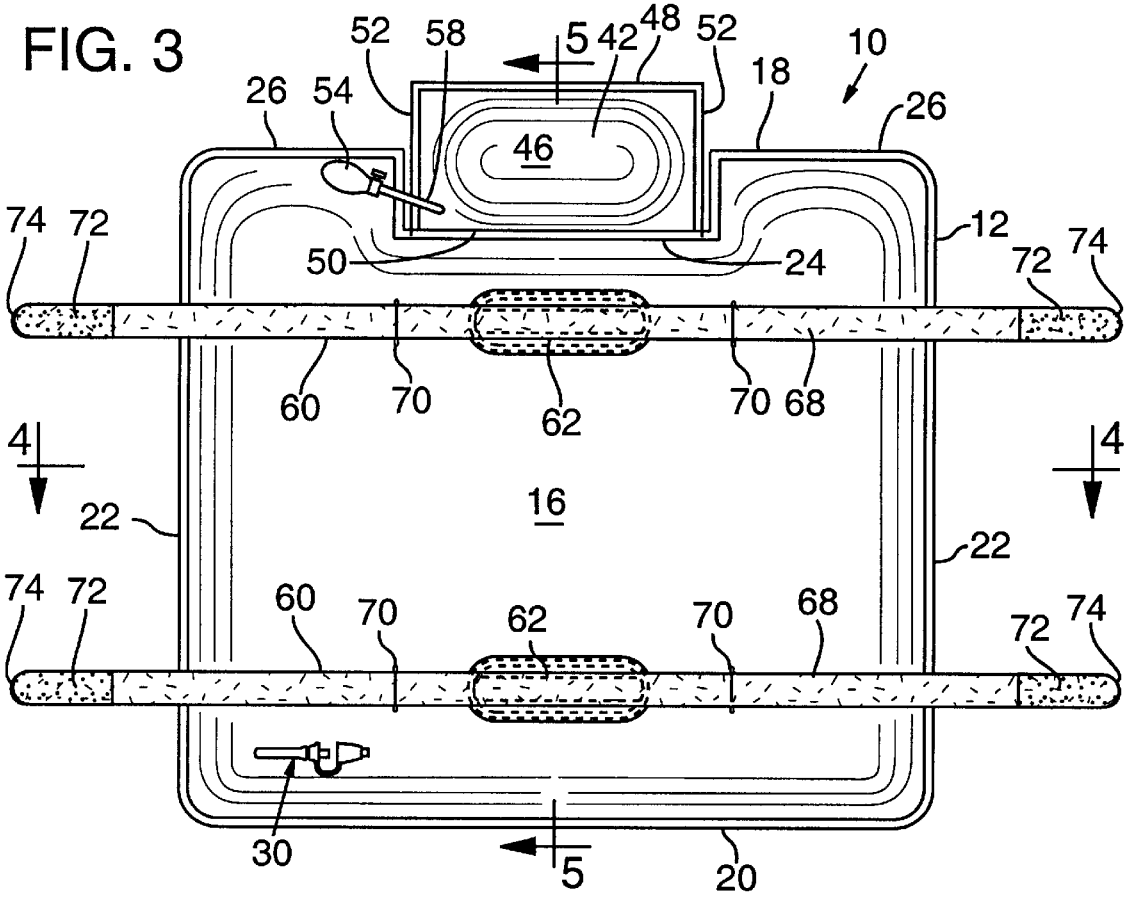
FIG. 3 is a bottom plan view of a first embodiment of the device of the invention.

A feature of the invention is an inflatable pillow 42 which is attached to the center portions 24 of the upper edges 18 of the top and bottom walls 14, 16 between the shoulder and thoracic support regions 26, as shown in FIGS. 3 and 5. Thus, the pillow 42 is attached to the bag substantially centrally thereof at the upper edges 18 of the center portions 24 of the walls 14, 16. It is to be noted that there is no communication between the interiors of the bag 12 and the pillow 42, each of which constitutes an air impermeable compartment of its own. I have found that preferred dimensions for the pillow 42 are a width of 14 inches (to fit the center portions 24) and a length of seven inches.

The purpose of the pillow 42 is to provide support for the patient's axilla (arm pit) when the bag 12 is evacuated and made rigid, thereby to prevent injury to the brachial plexus. See FIG. 1. The pillow 42 is fabricated of the same material as is the bag 12 itself. As shown in FIGS. 3 and 5, it comprises top and bottom opposing walls 44, 46 radio frequency welded together along their upper, lower and lateral edges 48, 50, 52 like the walls 14, 16 of the bag 12. A hand held inflation bulb 54 having a release valve 56 (see FIGS. 3 and 6) is attached to a length of plastic tubing 58 itself radio frequency welded to the bottom wall 46 of the pillow 42. The pillow 42 is inflated according to the needs and anatomy of each individual patient to support the axilla. This prevents stretching and/or compression of and thus injury to the brachial plexus. The pillow 42 can be utilized in the extended position (as shown in the solid lines in FIG. 1) to accommodate the above average and average size patient. Or, it can be folded forward toward the lower edges of the walls 14, 16 (as shown in the dashed lines in FIG. 1) to accommodate smaller patients.

As shown in FIGS. 3 and 4, the bottom wall 16 of the bag 12 is provided with a pair of laterally extending 54-inch long Velcro® brand hook-and-loop fastener straps 60 radio-frequency welded at their centers 62 to the center of the wall 16 so that the bag 12 can be securely attached to the rails 64 typically located at the sides of a surgical operating table 66. See FIG. 2. The loop portions 68 of the straps 60 preferably face away from the bottom wall 16 of the bag 12; i.e., toward the upper surface of the operating table 66. See FIG. 2. The straps are passed below the table 66, interiorly of the rails 64, then around them, through 1.5-inch D-rings 70, whereupon the hook portions 72 at the ends 74 of the straps 60 are folded back upon the loop portions 68 thereof to provide final security to the anaesthetized patient. Again see FIG. 2. The straps 60 are preferably made of 1.5-inch wide "Ultra-mate" Velcro®. The hook portions 72 at the ends 74 of the straps 60 are preferably five inches long and have rounded ends, as shown in FIG. 3.

Figure 8:
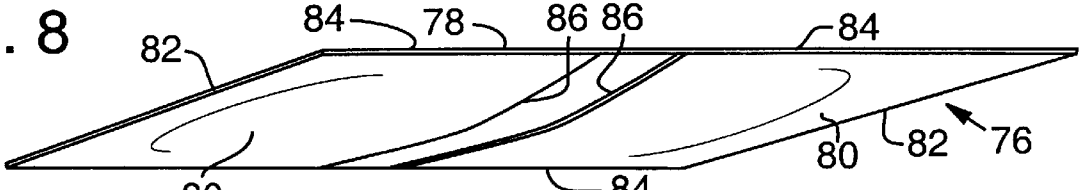
FIG. 8 is a perspective view of a protective, waterproof slipcover that may be used with the invention.

A further feature of the invention is a disposable, waterproof slipcover 76. As shown in FIG. 8, the slipcover 76 comprises an upper wall 78 and a pair of lower walls 80 formed by folding the upper wall 78 at the lateral edges 82 thereof and then seaming the upper and lower edges 84 of the lower walls 80 to the upper wall 78 along the upper and lower edges 84 of the lower walls 80. The lower walls 80 together with the upper wall 78 thus define a pair of longitudinally extending pockets 86 disposed at the lateral edges 82 of the upper wall 78 such that the sides of the bag 12 can be slipped inside the pockets 86. In this manner the upper wall 78 of the slipcover 76 serves to protect the bag 12 from being soiled during a surgical procedure.

Desirable dimensions for the slipcover 76 are 36 inches in overall width and 39 inches in overall length. This has been found satisfactory for a bag 36 inches wide and 32 inches long, having a 14-inch wide and seven-inch long pillow, which are the preferred dimensions of the bag 12 and pillow 42 of the first embodiment. The slipcover pockets 86 are each desirably fourteen inches wide, which leaves an eight inch space therebetween to receive and retrieve the bag 12.

Suitable fabric for the slipcover 76 is obtainable from the Formed Fabrics Division of Precision Fabrics Group, Inc., 301 North Elm Street, Greensboro, N.C. 27401, as its Style No. 718-90270. This is a finished polyester and polyethylene film laminate (a non-woven fabric) and is available in a 39 inch width such that the fourteen inch wide pockets 86 required by the first embodiment and formed by the lower walls 80 can merely be folded from a 64 inch long strip. Other suitable materials having similar physical properties may be used.

Second Embodiment

Figure 9:
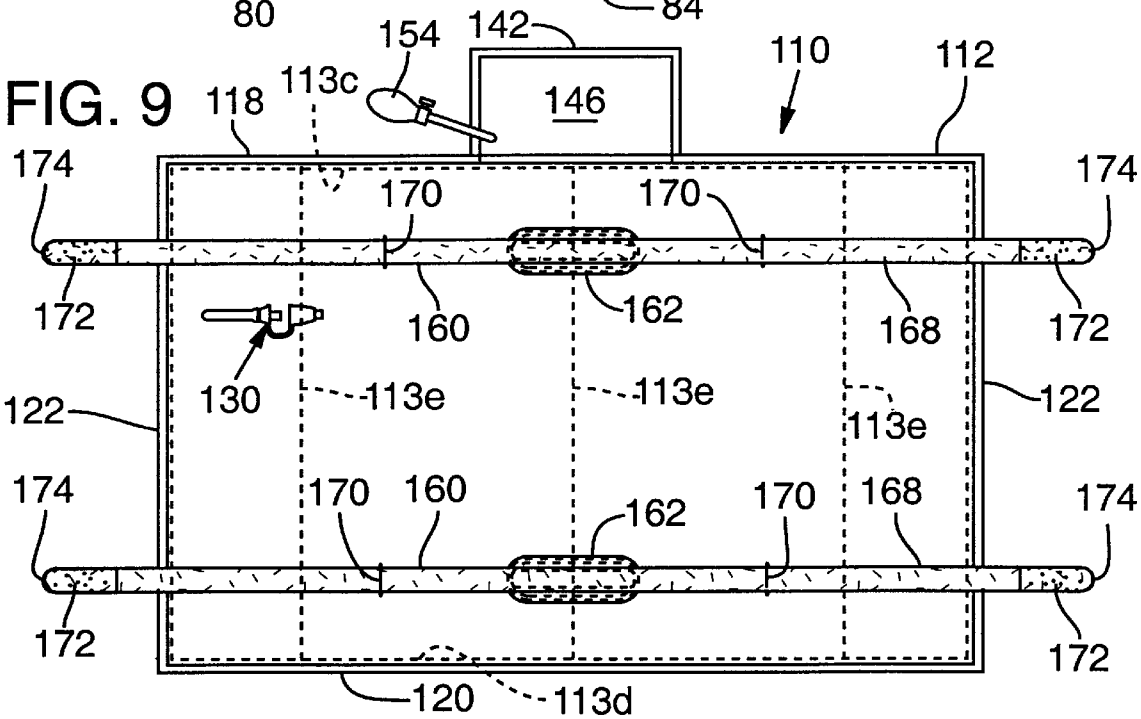
FIG. 9 is a bottom plan view of a second embodiment of the device of the invention.
Figure 10:
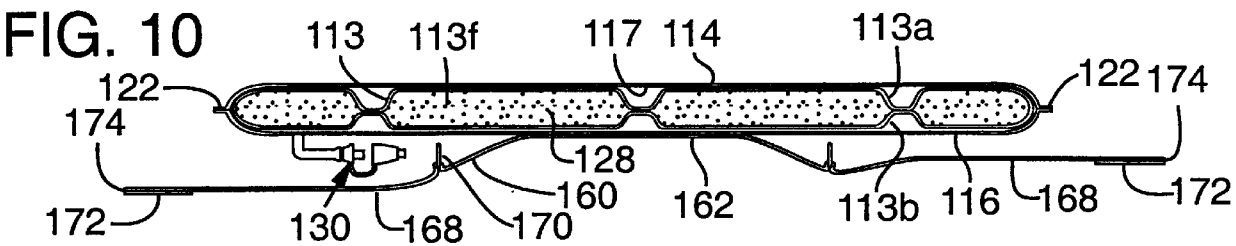
FIG. 10 is a sectional view on line 10—10 of FIG. 9.

A second embodiment of the invention is shown in FIGS. 9 and 10. The device 110 is fabricated using the same flexible, air impermeable material as the first embodiment device 10. The device 110 comprises an exterior bag 112 having top and bottom exterior opposing walls 114, 116 similarly radio frequency welded together at their upper, lower and lateral edges 118, 120, 122. The exterior walls 114, 116 are preferably 46 inches wide and 29 inches long. The upper edges 118, however, are not indented as are the upper edges 18 of the bag 12 of the first embodiment device 10. An inflatable axillary support pillow 142 fourteen inches wide and seven inches long is radio frequency welded to the upper edges 118 of the exterior walls 114, 116 at the centers of their upper edges 118.

The second embodiment bag 112 differs from the first embodiment bag 12 in that it also comprises an inner bag 113 made of gas permeable DuPont Lycra® fabric for which the exterior opposing walls 114, 116 of the exterior bag 112 function as a protective shell 117. The inner Lycra® bag 113 is not fastened to the outer protective shell 117, but comprises independent walls 113*a*, 113*b*, which are joined together between their upper and lower edges 113*c*, 113*d* along three intermediate, longitudinally extending lines 113*e*. The lines 113*e* divide the inner bag 113 into four longitudinally extending compartments 113*f*. As in the first embodiment, the compartments 113*f* are each filled with a charge of elastically deformable polystyrene plastic beads 128. The walls 113*a*, 113*b* of the inner bag 113 are joined along the lines 113*e* in a manner that permits the flow of air, but no movement of the beads 128, from one compartment 113*f* to another.

As in the device 10 of the first embodiment, the bottom exterior wall 116 is provided with a valve 130, for example a Colder Products Company valve, for evacuating air from the bag 112. When air is evacuated using a vacuum pump, the plastic beads 128 in the inner bag 113 congregate into a tight configuration, causing the entire device to conform to the contour of the patient's torso, as in the device 10 of the first embodiment.

The pillow 142 of the second embodiment is made the same as the pillow 42 of the first embodiment. It is similarly provided with a hand held inflation bulb 154 radio frequency welded to the bottom wall 146 thereof. As in the case of the first embodiment, the pillow 142 can be utilized in the extended position (see the solid line representation in FIG. 1) to accommodate average and above average size patients. Or it can be folded toward the center of the bag 112 to accommodate smaller patients, as shown in the dashed line representation in FIG. 1.

As in the first embodiment, the bottom exterior wall 116 is provided with a pair of similar laterally extending Velcro® brand hook-and-loop fastener straps 160 radio frequency welded at their centers 162 to the center of the wall 116 securely to attach the bag 112 to the rails of the operating table. Again, the loop portions 168 of the straps 160 preferably face away from the bottom wall 116 of the bag 112; i.e., toward the upper surface of the operating table 66. The straps are passed below the table 66, interiorly of the rails 64, then around them, through 1.5-inch D-rings 170, whereupon the hook portions 172 at the ends of the straps 160 are folded back upon the loop portions 168 thereof to provide the final security. The device 110 of the second embodiment may be provided with a slipcover as in the case of the device 10 of the first embodiment.

Method of the Invention

In using the device of the invention, the device 10, 110 is first placed on the operating table 66 with the fastener straps

60, 160 down next to the pad on the operating table and with the inflatable axillary pillow 42, 142 toward the head of the operating table. The hook portions 72, 172 of the fastener straps 60, 160 are then passed between the inside of the operating table side rails 64 and the lateral sides 66*a* of the operating table, then underneath and around the outside of the side rails 64 and through the D-rings 70, 170. The ends 74, 174 of the fastener straps 60, 160 are then pulled down until the straps 60, 160 are snug and the device 10, 110 is centered on the operating table 66, 166, whereupon the hook portions 72, 172 are folded back and affixed to the loop portions 68, 168 securely to fasten the device 10, 110 to the table 66.

The bag 12, 112 is then smoothed out so that the beads 28, 128 inside are evenly distributed. The disposable waterproof slipcover 76 is then placed over the bag 12, 112 with the laterally extending pockets 86 facing down. The sides of the bag 12, 112 are then inserted alternately into the pockets 86 of the disposable slipcover 76.

The patient P is then placed in the desired lateral position in the longitudinal center of the device 10, 110 with his lower axilla centered over the inflatable axillary pillow 42, 142, as shown in FIG. 1. The pillow 42, 142 can be utilized in the extended position to accommodate the average size adult patient. In the case of smaller or shorter patients, the pillow 42, 142 can be folded forward (toward the lower lateral edges of the device) before the patient is placed in position. The hand held inflation bulb 54, 154 is then used to inflate the pillow 42, 142 sufficiently to provide support for the axilla. It is important to make certain that the patient's radial artery pulse is present in the lower arm. It is also important to make certain that all the patient's extremities and bony prominences are well padded by the bag 12, 112, and that the head and neck are supported in the neutral position, as shown in FIG. 1.

The lateral sides of the bag 12, 112 are then folded upwardly to approximate the anterior and posterior aspects of the patient. It is important to ensure that no portion of the bag impinges on any of the patient's extremities or on any part of the potential surgical field. The lateral sides of the bag 12, 112 are snugly packed against the anterior and posterior portions of the patient's torso to accommodate the natural contours thereof and to form a generally triangular base of support at the patient's lateral down side.

While holding the patient in the desired position and the sides of the bag snugly against the anterior and posterior aspects of the patient, air is evacuated from the interior of the bag 12, 112. Specifically, the female portion 34 of the evacuation valve 30, 130 is attached to the male portion 32 thereof. While continuing to hold the sides of the bag 12, 112 snugly against the patient, the vacuum source is connected to the end of the female portion 34 to evacuate air from the interior of the bag 12, 112. Evacuation is continued sufficiently to make the bag firm, thereby to provide rigid lateral support to the patient. When satisfied with the achieved support, the female portion 34 is detached from the male portion 32 of the valve 30, 130 and then the vacuum source is detached from the female portion 34. The bag 12, 112 will then maintain its rigid conforming shape.

When the surgical procedure is completed, air is reintroduced into the bag 12, 112 to loosen the beads 28, 128 and allow the bag 12, 112 to become flat and flaccid. This can be accomplished by reconnecting the female portion 34 of the valve 30, 130 to the male portion 32, or the air can be reintroduced by pressing the thumb nail on the valve stem 36. The patient can then be removed from the operating table 66, the disposable slipcover 76 is removed, and the bag 12, 112 cleaned with a germicidal spray, as necessary.

While I have shown and described several embodiments of the present invention, it is to be understood that the same is not limited thereto, but is susceptible of numerous changes and modifications, as will be known to those skilled in the art, and I therefore do not wish to be limited to the details shown and described herein, but intend to cover all such changes and modifications as are encompassed by the scope of the following claims.

I claim:

1. A surgical positioning device for supporting the body of a patient in a selected position, comprising a bag made of flexible, air impermeable material, the bag having top and bottom opposing walls, the walls having upper, lower and lateral edges, the walls being air impermeably joined at their upper, lower and lateral edges;

the walls having a width at least equal to the sum of the widths of the lateral portion of the patient's torso plus about one-half the widths of the anterior and posterior portions of the patient's torso, the walls having a length about the same as the length of the patient's torso;

a charge of elastically deformable beads disposed within the bag;

a valve communicating with the interior of the bag for evacuating air therefrom, whereupon the beads in the bag interengage to form a rigid structure to support the patient's body in the selected position;

an inflatable pillow attached to the upper edges of the walls substantially centrally of the bag; and means to inflate the pillow, the pillow being adapted, when inflated, to support the patient's axilla and eliminate axillary pressure, thereby to prevent injury to the patient's brachial plexus.

2. A device as in claim 1, wherein the upper edges of the top and bottom walls are indented at the lateral centers thereof to provide a reduced length center portion of the bag and a pair of support regions at the sides thereof, the support regions being adapted to provide support for the patient's shoulders, the inflatable pillow being attached to the upper edges of the walls at the reduced length center portion thereof.

3. A device as in claim 1, further comprising at least one laterally extending strap attached centrally to the bottom wall of the bag, the strap having ends adapted to be attached to the rails on the sides of a surgical operating table.

4. A device as in claim 1, further comprising a waterproof slipcover enclosing the bag.

5. A device as in claim 4, wherein the slip cover comprises an upper wall and a pair of lower walls attached to the upper wall at the lateral edges thereof, the lower walls defining a pair of longitudinally extending pockets disposed at the lateral edges of the upper wall, the pockets being adapted to receive the lateral edges of the bag.

6. A device as in claim 1, wherein the bag comprises a first exterior bag and an air permeable inner bag disposed within the first exterior bag, the air impermeable inner bag comprising top and bottom opposing walls having upper, lower and lateral edges, the top and bottom opposing walls of the inner bag being joined between their upper and lower edges along at least one longitudinally extending line to divide the inner bag into a plurality of longitudinally extending compartments, the beads being disposed within the compartments, the walls of the inner bag being joined along the longitudinally extending line to permit the flow of air, but prevent the movement of beads, from one compartment to the other.

7. A device as in claim 6, further comprising at least one laterally extending strap attached to the center of the bottom wall of the exterior bag, the strap having ends adapted to be attached to the rails on the sides of a surgical operating table.

8. A method of supporting the body of a patient in a selected position for surgery when the patient requires placement in the lateral position, comprising:

providing a surgical positioning device for supporting the body of the patient in the selected position on an operating table, the device comprising:

a bag made of a flexible, air impermeable material, the bag having top and bottom opposing walls, the walls having upper, lower and lateral edges, the walls being air impermeably joined at their upper, lower and lateral edges, the walls having a width at least equal to the sum of the widths of the lateral portion of the patient's torso plus about one-half the widths of the anterior and posterior portions of the patient's torso, the walls having a length about the same as the length of the patient's torso, a charge of elastically deformable beads disposed within the bag, a valve communicating with the interior of the bag for evacuating air therefrom, whereupon the beads in the bag interengage to form a rigid structure to support the patient's torso in the selected position, an inflatable pillow attached to the upper edges of the walls substantially centrally of the bag, and means to inflate the pillow;

the method comprising:

placing the device on the operating table with the inflatable pillow toward the head of the table;

evenly distributing the spherical beads within the device;

placing the patient on the device in the selected lateral position, the patient being placed in the longitudinal center of the device with the lower axilla of the patient centered over the inflatable pillow;

inflating the pillow to support the patient's axilla with radial artery pulse present in the lower arm;

folding the lateral portions of the device up toward the anterior and posterior portions of the patient's torso;

packing the lateral portions of the device snugly against the anterior and posterior portions of the patient's torso to accommodate the natural contours thereof; and evacuating the air from the interior of the device while holding the patient in the selected position to cause the beads to interengage to form a rigid structure conforming to the contours of the patient's torso.

9. The method of claim 8, further comprising folding the inflatable pillow toward the center of the device prior to placing the patient on the device with the lower axilla of the patient centered over the pillow.

* * * * *

UNITED STATES PATENT AND TRADEMARK OFFICE

CERTIFICATE OF CORRECTION

PATENT NO. : 5,906,205

DATED : May 25, 1999

INVENTOR(S) : Eugene Lloyd Hiebert

It is certified that error appears in the above-identified patent and that said Letters Patent is hereby corrected as shown below:

On the Cover Page at [56]: insert

| Number | Date | Name | Class | Sub |
|---|---|---|---|---|
| Des.362,913 | 10/1995 | Eisenberg et al. | D24 | 190 |
| 3,212,497 | 10/1965 | Dickinson | 128 | 87 |
| 4,234,982 | 11/1980 | Bez et al. | 5 | 455 |
| 4,657,003 | 4/1987 | Wirtz | 128 | 133 |
| 4,862,879 | 9/1989 | Coombs | 128 | 87R |
| 4,962,769 | 10/1990 | Garcia | 128 | 889 |
| 4,999,867 | 3/1991 | Toivio et al. | 5 | 455 |
| 5,121,756 | 6/1992 | Koledin | 128 | 870 |
| 5,154,875 | 10/1992 | Latimer et al. | 128 | 870 |
| 5,586,348 | 12/1996 | Toivio et al. | 5 | 710 |
| 5,621,934 | 4/1997 | Olkkonen et al. | 5 | 710 |
| 5,626,150 | 5/1997 | Johnson et al. | 128 | 870 |

In the Specification:

Column 2, line 40, "the patent in" should be --the patient in--
Column 4, line 49, "hold the patient fly" should be --hold the patient firmly--;
Column 7, line 9, "table 66, 166" should be --table 66--.

UNITED STATES PATENT AND TRADEMARK OFFICE

CERTIFICATE OF CORRECTION

PATENT NO. : 5,906,205

DATED : May 25, 1999

INVENTOR(S) : Eugene Lloyd Hiebert

It is certified that error appears in the above-identified patent and that said Letters Patent is hereby corrected as shown below:

In the Claims:

Column 8, line 57, "impermeable" should be --permeable--.

Signed and Sealed this

Twenty-second Day of August, 2000

*Attest:*

Q. TODD DICKINSON

*Attesting Officer*

*Director of Patents and Trademarks*